US009815096B2

(12) United States Patent
Osaland

(10) Patent No.: US 9,815,096 B2
(45) Date of Patent: Nov. 14, 2017

(54) METHOD AND A DEVICE FOR CLEANING AN AREA LOCATED INSIDE A RESTRICTION

(75) Inventor: Espen Osaland, Sandnes (NO)

(73) Assignee: Altus Intervention AS, Stavenger (NO)

( * ) Notice: Subject to any disclaimer, the term of this patent is extended or adjusted under 35 U.S.C. 154(b) by 851 days.

(21) Appl. No.: 13/880,837

(22) PCT Filed: Oct. 21, 2011

(86) PCT No.: PCT/NO2011/000298

§ 371 (c)(1),
(2), (4) Date: May 7, 2013

(87) PCT Pub. No.: WO2012/060712

PCT Pub. Date: May 10, 2012

(65) Prior Publication Data

US 2014/0150822 A1 Jun. 5, 2014

(30) Foreign Application Priority Data

Nov. 3, 2010 (NO) ..... 20101542

(51) Int. Cl.

| | |
|---|---|
| ***E21B 37/02*** | (2006.01) |
| ***B08B 9/045*** | (2006.01) |
| ***B08B 9/043*** | (2006.01) |
| *B08B 9/02* | (2006.01) |

(52) U.S. Cl.
CPC ..... *B08B 9/045* (2013.01); *B08B 9/0436* (2013.01); *E21B 37/02* (2013.01)

(58) Field of Classification Search
CPC ..... B08B 9/0436; B08B 9/045; B08B 9/0553; B08B 9/055; B08B 9/0551; B08B 9/0557; E21B 37/02
See application file for complete search history.

(56) References Cited

U.S. PATENT DOCUMENTS 5,931,239 A * 8/1999 Schuh ..... E21B 7/062 175/107
2009/0169319 A1* 7/2009 Hart ..... E21B 29/10 408/227

FOREIGN PATENT DOCUMENTS

| | | | | |
|---|---|---|---|---|
| DE | 3428133 A1 | | 2/1986 | |
| GB | 191220823 A | * | 0/1913 | ..... B08B 9/0436 |
| GB | 191508306 A | | 9/1915 | |
| NO | WO 2009123468 A1 | * | 10/2009 | ..... B08B 9/0436 |
| WO | 2006016102 A1 | | 2/2006 | |
| WO | 2007003894 A2 | | 1/2007 | |
| WO | 2009108068 A1 | | 9/2009 | |
| WO | WO2009123468 | | 10/2009 | |

(Continued)

*Primary Examiner* — Douglas Lee
(74) *Attorney, Agent, or Firm* — Gable Gotwals

(57) ABSTRACT

A method and a device for cleaning an area (48) located inside a restriction (46) by means of a mechanical cleaning tool (1). The restriction (46) having a smaller cross-sectional dimension than the area (48) to be cleaned. The method includes the steps of moving the cleaning tool (1) into or through the restriction (46); moving a mechanical cleaning body (18) radially out into abutment against the area (48) to be cleaned; rotating the cleaning body (18) relative to the area (48) to be cleaned; moving the mechanical cleaning body (18) radially in from the area (48) which has been cleaned; and moving the cleaning tool (1) out from the restriction (46).

7 Claims, 4 Drawing Sheets

(56) References Cited

FOREIGN PATENT DOCUMENTS

| | | | | | |
|---|---|---|---|---|---|
| WO | WO 2009123468 | A1 * | 10/2009 | ..... | B08B 9/0436 |
| WO | 2010015861 | A2 | 2/2010 | | |

* cited by examiner

METHOD AND A DEVICE FOR CLEANING AN AREA LOCATED INSIDE A RESTRICTION

CROSS-REFERENCE TO RELATED APPLICATIONS

This United States National Phase of PCT Application No. PCT/NO2011/000298 filed 21 Oct. 2011, claims priority to Norwegian Patent Application No. 20101542 filed 3 Nov. 2010, each of which are incorporated herein by reference.

BACKGROUND OF THE INVENTION

This invention relates to a cleaning tool. More particularly, it relates to a method of cleaning an area located inside a restriction by means of a mechanical cleaning tool, the restriction having a smaller cross-sectional dimension than the area to be cleaned. The invention also includes a device for practising the method.

When, for example, components in a petroleum well are being cleaned, it happens relatively often that the area to be cleaned is inside a restriction which has a smaller diameter than the cleaning area.

An example is a downhole safety valve which needs to be cleaned of deposits, and wherein it is necessary to pass through a smaller opening to get in to the sealing area of the valve. It may also be relevant to clean portions of a pipe where the portion is inside a restriction, and where a plug is to be set, for example.

According to the prior art, brushes with relatively long, soft brushing elements are often used, which may result in uncertain effect of the cleaning operation.

The invention has for its object to remedy or reduce at least one of the drawbacks of the prior art.

The object is achieved in accordance with the invention through the features which are specified in the description below and in the claims that follow.

A method of cleaning an area located inside a restriction by means of a mechanical cleaning tool is provided, the restriction having a smaller cross-sectional dimension than the area to be cleaned, the method comprising:

- moving the cleaning tool into or through the restriction;
- moving a mechanical cleaning body radially out into abutment against the area to be cleaned;
- rotating the cleaning body relative to the area to be cleaned;
- moving the mechanical cleaning body radially in from the area which has been cleaned; and
- moving the cleaning tool out from the restriction.

The method thereby makes it possible also for areas located inside a restriction to be cleaned mechanically in a satisfactory manner.

The method may further include activation of the cleaning tool by means of a rotary adapter which includes an actuator for the axial displacement of a pushrod, the rotary adapter being connected to a wireline tractor.

The cleaning tool is thus adapted to known equipment available at many points of application.

The method may be practised by means of a cleaning tool which includes a tool housing and a mechanical cleaning body arranged to clean the area in question by means of mechanical contact and relative movement between the cleaning body and an area to be cleaned, and which is characterized by the cleaning body being arranged on an attachment in which at least the part of the attachment holding the cleaning body is radially movable between a retracted, idle position and an extended, active position.

The distance between the centre axis of the cleaning tool and the cleaning body, when the cleaning body is in its extended, active position, is larger than half the cross-sectional dimension of a restriction located upstream of the area to be cleaned.

A pushrod may be connected to a cone which abuts against a corresponding first inclined plane internally on the attachment, an axial displacement of the cone in the direction of the free end portion of the housing bringing the attachment with the cleaning body to be moved radially outwards.

A compression spring which may be connected between the cone and the tool housing may be arranged to move the cone to its initial position.

The attachment may be formed with an external second inclined plane which is arranged to abut against an internal third inclined plane in the tool housing, an axial displacement of the attachment in the direction of the leading end portion of the tool housing bringing about an inward radial displacement of the cleaning body.

A guide ring which may be mounted on the rear portion of the tool housing may have been given a cross-sectional dimension that is larger than, for example, the cross-sectional dimension of the restriction.

Thereby the guide ring may be landed on, for example, a particular shoulder to positively position the cleaning tool in a particular position relative to the shoulder.

The tool housing may be connected to a rotary adapter which is provided with an actuator, and the actuator may be connected to the pushrod.

The rotary adapter may be connected to a wireline tractor.

The method and the device according to the invention make it possible for areas that are inside a restriction to be cleaned relatively easily by means of a mechanical cleaning tool.

In what follows, an example of a preferred method and embodiment is described, which is visualized in the accompanying drawings, in which.

Figure 1:
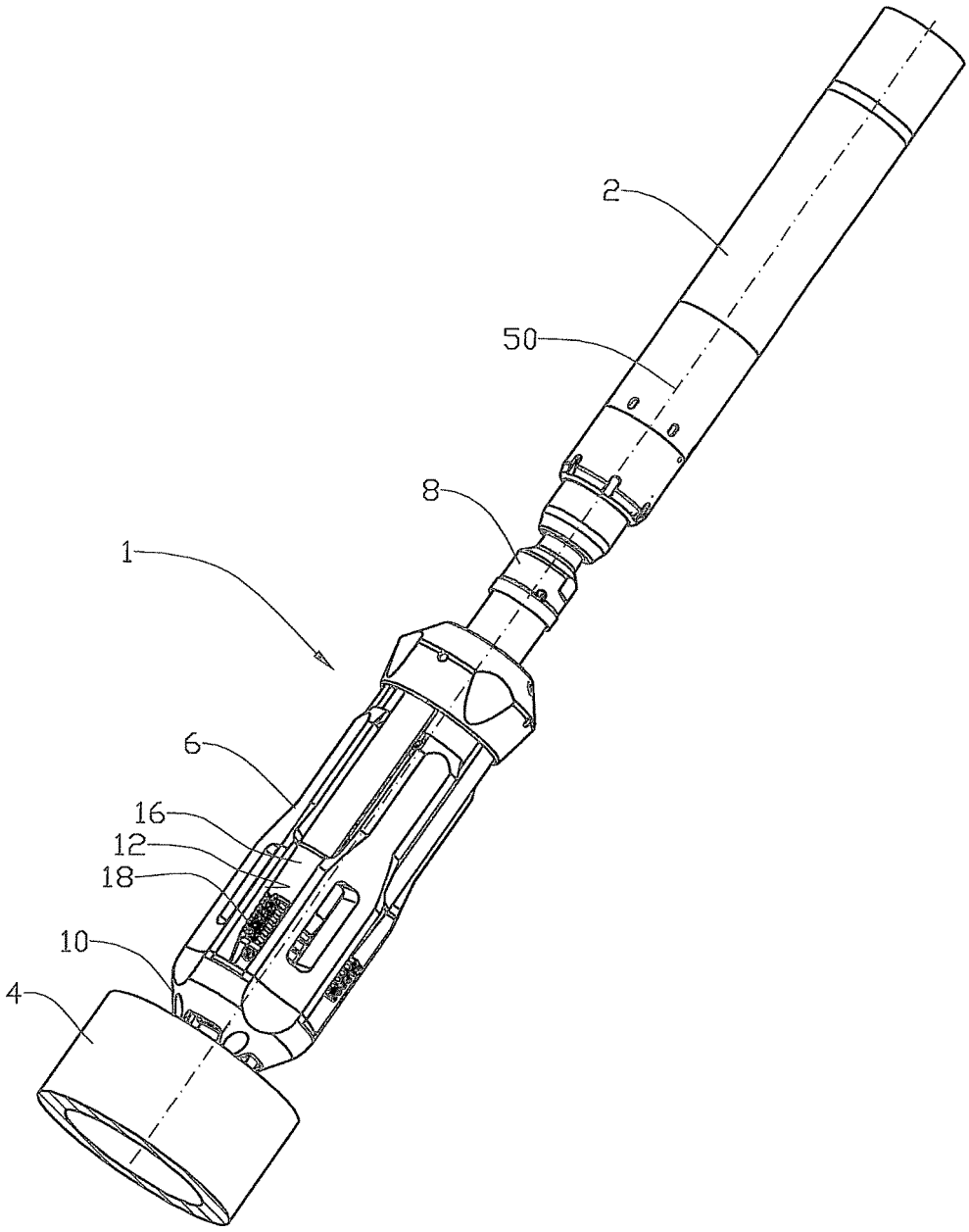
FIG. 1 shows, in perspective, a cleaning tool according to the invention, the cleaning tool being connected to a rotary adapter.

In the drawings, the reference numeral 1 indicates a cleaning tool which is connected to a rotary adapter 2 and inserted into a pipe 4 in the ground.

The cleaning tool 1 includes a tool housing 6 which is connected to the rotary axle 8 of the rotary adapter 2 and which has been given a rounded conical shape at its opposite leading end portion 10.

The tool housing 6 is formed with four longitudinal cut-outs 12, there being, arranged in each of the cut-outs 12, an attachment 16 for a respective cleaning body 18, here in the form of relatively stiff-bristled brushes.

Figure 2:
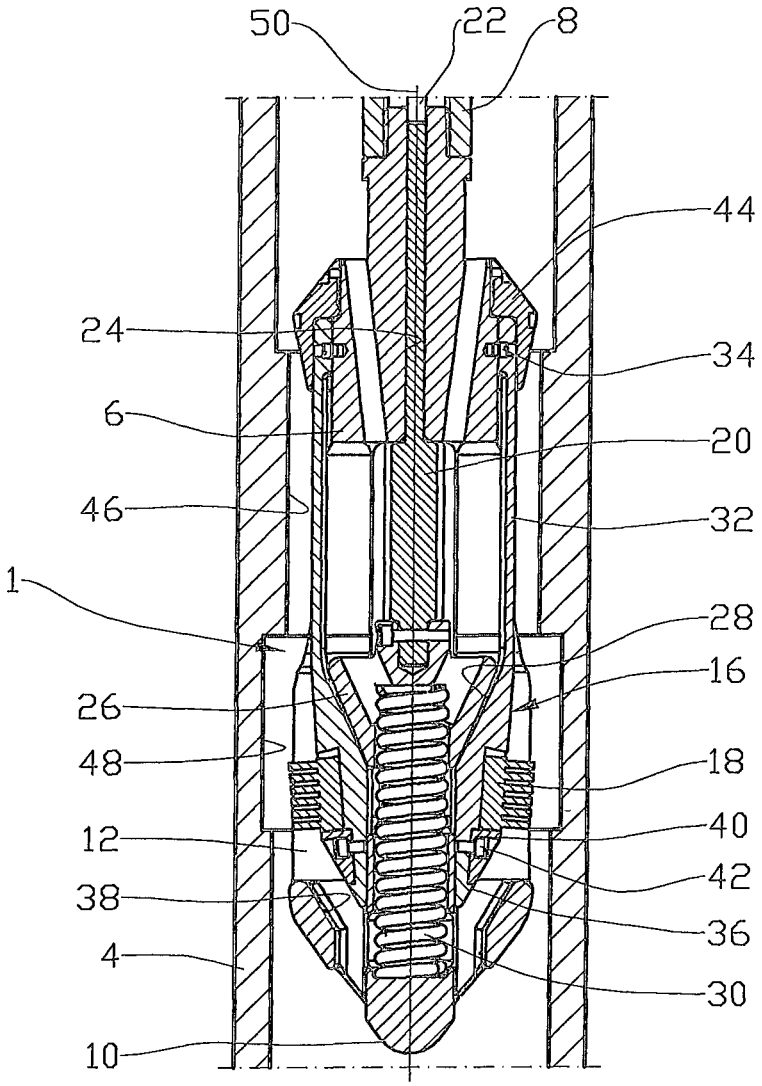
FIG. 2 shows, in section, the cleaning tool of FIG. 1, the cleaning bodies being in their passive positions.

A pushrod 20, stopping against an actuator 22 in the rotary adapter 2, extends in part within a bore 24 in the tool housing 6, see FIG. 2. The pushrod 20 is connected to a cone 26 which abuts against a first inclined plane 28 on the inside of the attachments 16. A compression spring 30 is arranged between the cone 26 on the opposite side relative to the pushrod 20 and the tool housing 6 near the leading end portion 10.

Each of the attachments 16 is formed with an elongated resilient portion 32 which is attached to the tool housing 6 by means of a rupture body 34. In its opposite end portion, the attachment 16 is provided with an external second inclined plane 36 which is arranged to cooperate with an internal third inclined plane 38 in the tool housing 6.

The cleaning bodies 18 are attached to the attachment 16 by means of a clamp 40 and clamping bolt 42.

A guide ring 44 has been slipped over the tool housing 6 and the resilient portion 32 at the rupture bodies 34.

The cleaning tool 1 with the rotary adapter 2 is moved into a pipe 4 in which there is a restriction 46, here in the form of a narrowing of the pipe 4.

In FIG. 2, the cleaning tool 1 has partly been moved through the restriction 46, the cleaning bodies 18 being at an area 48 which is to be cleaned.

When energy is supplied to the rotary adapter 2, the rotary axle 8 and the cleaning tool 1 are rotated about their longitudinal axis 50 while, at the same time, the actuator 22 moves the pushrod 20 and cone 26 in the direction of the leading end portion 10.

Figure 3:
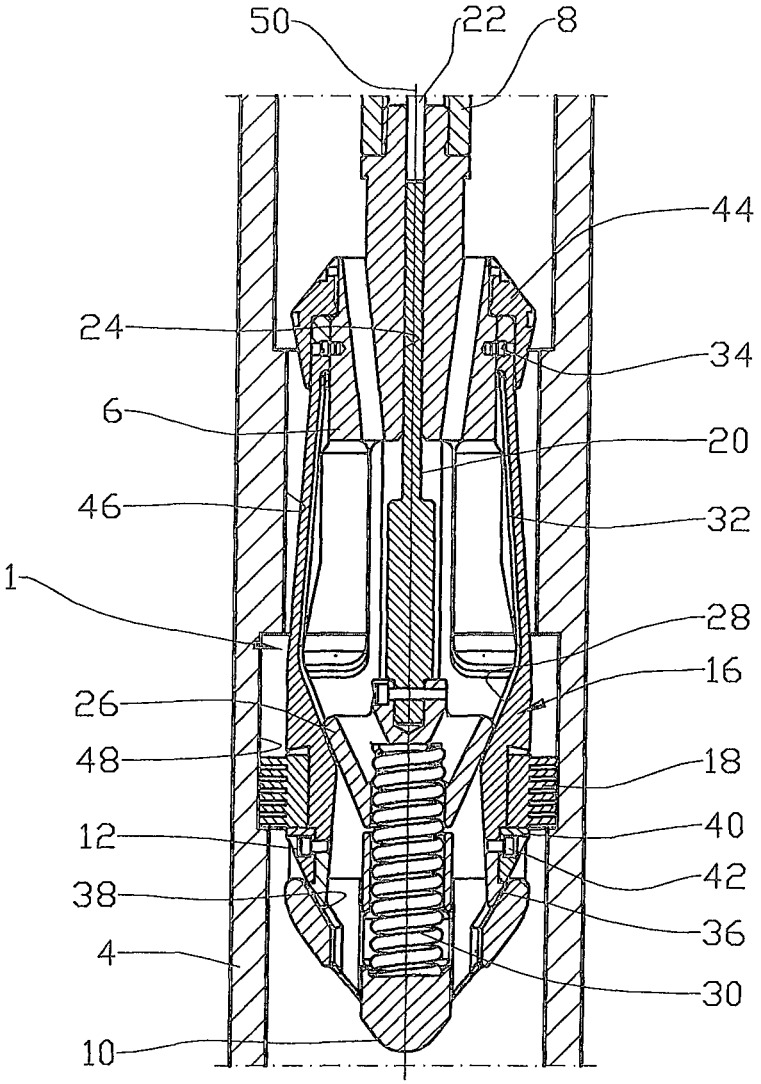
FIG. 3 shows the same as FIG. 2, but he cleaning tools are in their active positions.

The displacement of the cone 26 has the effect of tightening the compression spring 30 while, at the same time, the cone 26 is being moved along the first inclined planes 28, whereby, the attachments 16 with their respective cleaning bodies 18 are moved radially from an idle position into an active position, see FIG. 3.

The bearing force and rotation against the area 48 to be cleaned has the effect of a reliable cleaning operation being performed.

When the cleaning operation has been carried out, the rotary adapter 2 is stopped. The compression spring 30 moves the cone 26 towards its initial position, whereby the resilient portion 32 turns the respective cleaning bodies 18 into their passive positions.

Figure 4:
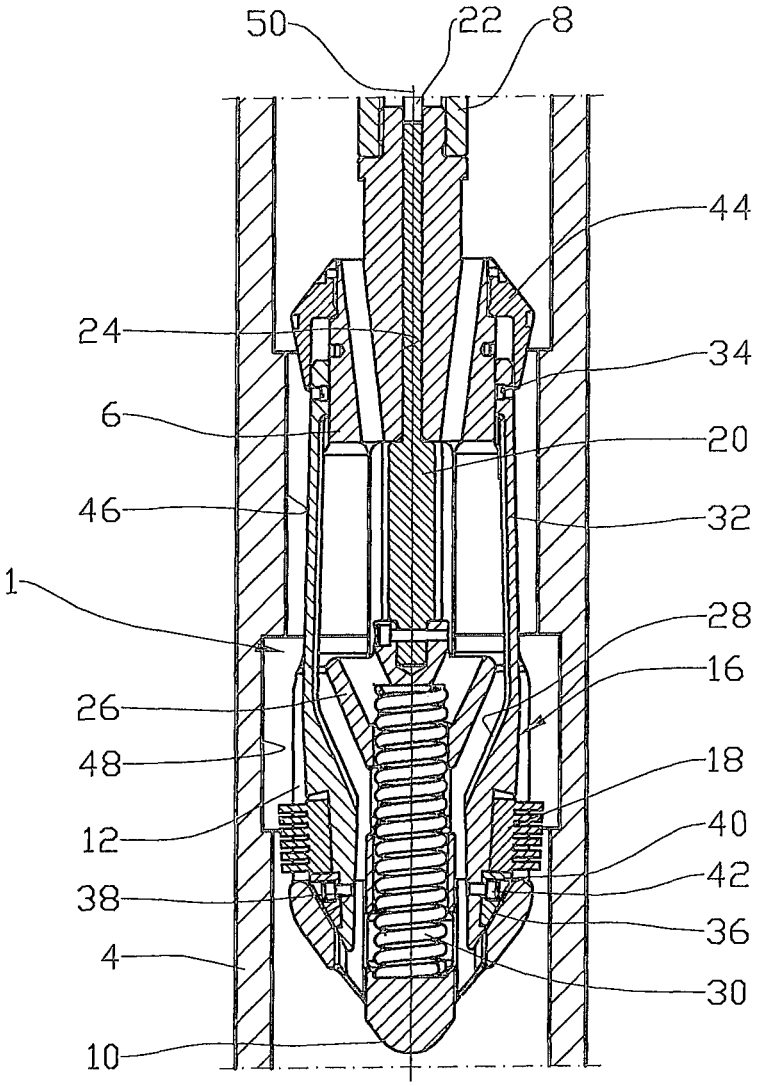
FIG. 4 shows the same as FIG. 2, but after the cleaning bodies have been retracted after having been stuck in their active positions.

If one or more of the attachments 16 with cleaning bodies 18 should have got stuck in its/their active position(s), the rupture body 34 may be ruptured by moving the tool housing 6 in the direction of the rotary adapter 2. The second inclined planes 36 of the attachments 16 are thereby moved against the third inclined planes 38 in the tool housing 6. This has the effect of enabling the attachments 16 and the cleaning bodies 18 to be pushed radially inwards at relatively great force. The guide ring 44 prevents the attachments 16 from falling out of the tool housing 6, see FIG. 4.

While the invention has been described with a certain degree of particularity, many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. A cleaning tool (1) comprising:

a tool housing with a leading end portion;

an attachment, said attachment forms an internal side facing a centre axis of the cleaning tool and an opposite external side, said attachment is formed with an elongated resilient portion and an opposite end portion, said attachment comprises on the internal side an internal first inclined plane and on the external side at the end portion an external second inclined plane;

a mechanical cleaning body being arranged on the external side of the attachment;

third internal inclined planes at the leading end portion of the tool housing, said third internal inclined planes facing the centre axis;

at least a part of the attachment holding the cleaning body being radially movable between a retracted, idle position and a radially extended, active position; and the external second inclined plane is arranged to abut against an internal third inclined plane, an axial displacement of the attachment in a direction of a leading end portion of the tool housing bringing about an inward radial displacement of the cleaning body.

2. The cleaning tool in accordance with claim 1, wherein a pushrod is connected to a cone which abuts against the first inclined plane, an axial displacement of the cone from an initial, passive position in a direction of the leading end portion of the tool housing to an active position brings the attachment with the cleaning body to be moved radially outwards.

3. The cleaning tool in accordance with claim 2, wherein a compression spring is connected between the cone and the tool housing, said compression spring moves the cone axially from the leading end portion and into the initial passive position.

4. The cleaning tool in accordance with claim 2, wherein the tool housing is connected to a rotary adapter which is provided with an actuator, the actuator being connected to the pushrod.

5. The cleaning tool in accordance with claim 4, wherein the rotary adapter is connected to a wireline tractor.

6. The cleaning tool in accordance with claim 1, wherein the attachment is further formed with an elongated resilient portion which at an end portion opposite to the cleaning body is attached to the tool housing by means of a rupture body.

7. The cleaning tool in accordance with claim 6, wherein a guide ring surrounds a portion of the resilient portion and the rupture body.

* * * * *